US005571566A

United States Patent [19]

Cho

[11] Patent Number: 5,571,566

[45] Date of Patent: Nov. 5, 1996

[54] METHOD OF MANUFACTURING A COATED STEEL

[75] Inventor: Nam-Geun Cho, Pusan, Rep. of Korea

[73] Assignee: Union Steel Manufacturing Co., Ltd., Pusan, Rep. of Korea

[21] Appl. No.: 379,911

[22] Filed: Jan. 30, 1995

[30] Foreign Application Priority Data

Mar. 10, 1994 [KR] Rep. of Korea ..... 4688/1994

[51] Int. Cl.[6] ..... B05D 3/04

[52] U.S. Cl. ..... 427/349; 427/431; 427/433; 427/436

[58] Field of Search ..... 427/431, 433, 427/436, 349

[56] References Cited

U.S. PATENT DOCUMENTS

| | | | |
|---|---|---|---|
| 3,952,120 | 4/1976 | Horton et al. | 427/433 |
| 4,456,663 | 6/1984 | Leonard | 428/653 |

FOREIGN PATENT DOCUMENTS

| | | | |
|---|---|---|---|
| 1283388 | 11/1989 | Japan | C23C 24/04 |
| 1290780 | 11/1989 | Japan | C23C 24/08 |
| 254771 | 2/1990 | Japan | C23C 18/12 |
| 5148668 | 6/1993 | Japan | C23C 28/02 |
| 5171461 | 7/1993 | Japan | C23C 22/78 |
| 947846 | 9/1992 | Rep. of Korea | C23C 2/06 |
| 94280 | 1/1994 | Rep. of Korea | C23C 28/00 |
| 941032 | 2/1994 | Rep. of Korea | C25D 9/08 |

*Primary Examiner*—Benjamin Utech
*Attorney, Agent, or Firm*—Helfgott & Karas, P.C.

[57] ABSTRACT

Alloy coating composition that is Al 55% by weight, Zn 43.4% by weight, Si 1.6% by weight, comprising addition of Ti to said composition at a concentration of 0.0001–0.5% by weight of said composition. Ti-Al alloy is melted preliminary in a premelt pot (2), and it, thus Ti, is introduced into the bath of coating pot (1). Then a steel plate is passed through the coating pot (1); and thus, the surface of the steel plate is treated with Ti which stifles growth of spangle particles.

10 Claims, 8 Drawing Sheets

COMPARISON of SPANGLE SIZE(magnified x1)

(with Ti ADDITION) (without Ti ADDITION)

COMPARISON of SPANGLE SIZE (magnified x1)

(with Ti ADDITION) (without Ti ADDITION)

SPANGLE SIZE with Ti ADDITION(magnified x1)

THE RESULTS OF 900 hrs. S.S.T

THE RESULTS OF 900 hrs. HUMIDITY TEST

O-T BENDING TEST & IMPACT TEST

DEPTH 5mm ERICHSEN TEST

| NON Ti G/L | WITH Ti G/L |
|---|---|
|  |  |
| NO CRACK | NO CRACK |

ESTIMATION

| | | | | | | | | |
|---|---|---|---|---|---|---|---|---|
| 1 | S.S.T | : | NON Ti G/L | « | WITH | Ti | G/L |
| 2 | H.T | : | NON Ti G/L | « | WITH | Ti | G/L |
| 3 | O-T BENDING | : | NON Ti G/L | ≦ | WITH | Ti | G/L |
| 4 | IMPACT TEST | : | NON Ti G/L | « | WITH | Ti | G/L |
| 5 | ERICHSEN TEST | : | NON Ti G/L | ≦ | WITH | Ti | G/L |

METHOD OF MANUFACTURING A COATED STEEL

FIELD OF THE INVENTION

The present invention relates to a method of manufacturing a coated steel plate for which the composition of the coating is Al 55% by weight, Zn 43.4% by weight, and Si 1.6% by weight, to which Ti is added to obtain better quality coated steel.

BACKGROUND OF THE INVENTION

In general, coated steel plates ("the galvalumes") are widely used for ornamental wall and roof materials in construction because it is corrosive resistant, durable, and superior in heat reflection. Minimizing the size of spangle particles that form on surface of a coated steel plate provides the plate with fine appearance and improves its corrosive resistance, durability, and ease of handling, which are very important considerations in this technical field.

Traditionally the galvalume has been manufactured by the following process. A steel plate is passed through a pot with melted alloy, coating composition, comprising of Al 55% by weight, Zn 43.4% by weight, and Si 1.6% by weight. Amount of coating put on the steel plate is controlled by a method of air wiping; then quenching is accomplished by a means of cooling. The size of spangle particles on surface of the coated steel plate depends on efficiency of the cooling, more efficient the cooling smaller the spangle particles.

However, the existing quenching method, i.e., the method of cooling, cannot guarantee uniform minimization of spangle particles because it depends on the quenching capacity, the length of quenching equipment, the temperature of the pot, and the line speed for production of the galvalume. It is very expensive to increase the cooling capacity to improve effectiveness of quenching that is needed to minimize the size of spangle particles; consequently, the existing galvalume production method is inefficient.

SUMMARY OF THE INVENTION

The object of the present invention is to provide a more efficient production method for manufacturing a coated steel plate. The present invention provides a method of uniformly minimizing the size of spangle particles by preventing their growth with so called "seed effect", i.e., when countless spangle particles are introduced in the coating, they interfere with their respective growth as the particles grow, keeping them minute and creating a coated steel plate with fine surface.

The manufacturing method of the present invention will be explained in more details below. The present invention adds Ti to the usual coating composition in a coating pot (1) to obtain said effect. The preferred embodiments will be described using the accompanying drawings as a reference to describe more clearly said object and other advantages of the present invention.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF PREFERRED EMBODIMENTS

Figure 1:
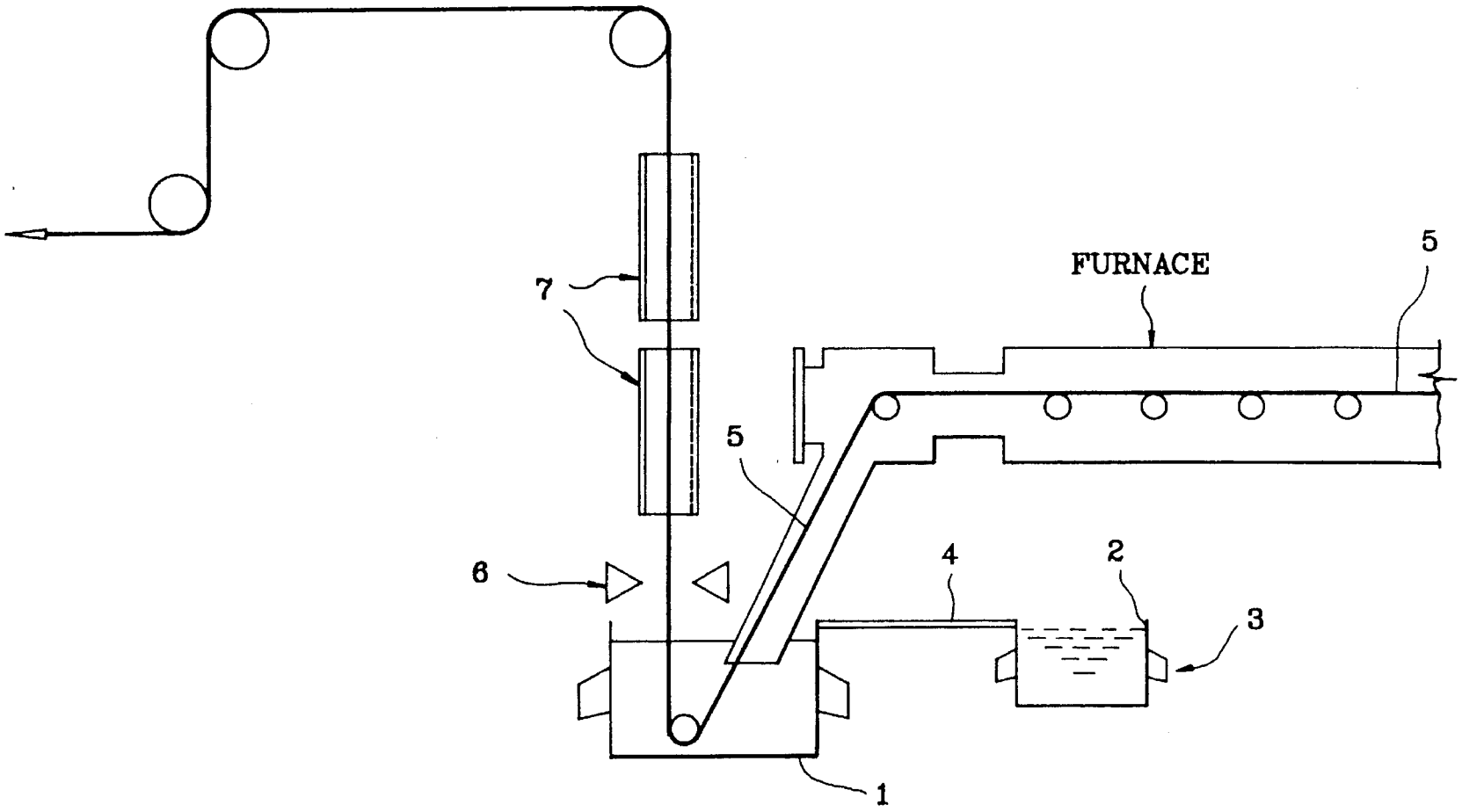
FIG. 1 is a schematic drawing that partially shows a coating process according to the present invention.

The following explains the method of manufacturing a coated steel plate, i.e., Ti-treated galvalumes. Note that the numbers used below correspond to the numbers used in FIG. 1. Traditionally, the coating composition ("the Composition") used to manufacture galvalume is Al 20–80% by weight, Si 0.1–2.0% by weight, and Zn for the balanced amount.

However, the coating composition used in the present invention is Al 55% by weight, Zn 43.4% by weight, and Si 1.6% by weight, to which Ti is added, creating an improved coating composition ("the Composition II"). To prepare the Composition II, a coating pot (1) containing the Composition and a supplementary pot, i.e., premelt pot (2), containing melted Ti-alloy ingot are employed. It is necessary to use Ti in melted state to control the amount of Ti being sent to the coating pot (1). Ti is very difficult to melt because of its high density (4.51) and high melting point (1668° C.); thus, to melt it easily in the premelt pot (2), the present invention employs Ti-Al alloy.

Said alloy ingot is easily melted at relatively low temperature (620°–680° C.). The amount of Ti in Ti-Al alloy is determined by the degree of melted state of Ti-Al alloy in the premelt pot (2) and the desired level of Ti concentration in the coating pot (1). The present invention shows that Ti at a concentration of 0.001–0.5% by weight of the Composition allows for the formation of the minutest spangle particles. To be able to obtain such a level of concentration of Ti in the coating pot (1), it is preferable to use Ti-Al alloy rather than Ti alone as explained above.

To melt Ti-Al alloy in the premelt pot (2), an electric furnace (3) is used. Ti-Al alloy easily melted and evenly diffused in the premelt pot (2) by keeping the bath temperature in the premelt pot (2) higher than the melting point of Ti-Al alloy (620°–680° C.) and by the erosion and corrosion caused by pinch effect which occurs due to electric magnetic power field in the furnace (3). The resulting molten alloy is introduced into the coating pot (1) along a gate (4).

A steel plate (5) is passed through the coating pot (1) so that the surface of the steel plate (5) is coated with the Composition II. The steel plate (5) is passed through an air wiping unit (6) and then a cooling equipment (7), quenching the steel plate (5). Since the resulting steel plate (5) is treated with Ti, innumerable seeds (i.e., spangle particles) are formed thereon, the seeds that interfere with each other's growth; consequently, the growth of spangle particles are stifled and the size of spangle particles are kept minute, so that the surface of the coated steel plate is made more graceful, corrosive resistant, and easy to handle.

Hereinafter, the test results of the present invention will be explained:

1. Comparison of the size of spangle particles of Ti-treated and not-Ti-treated galvalumes.

In FIG. 2, as can be seen from the magnified picture, the size of spangle particles on the surface of Ti-treated galvalumes appeared much finer than that of not-Ti-treated galvalumes. Thickness of the galvalumes used in the example are 0.4, 0.5, 0.6, 0.7, 0.8, and 1.0 mm.

2. Comparison of the size of spangle particles according to the thickness of Ti-treated galvalumes.

Figure 2A:
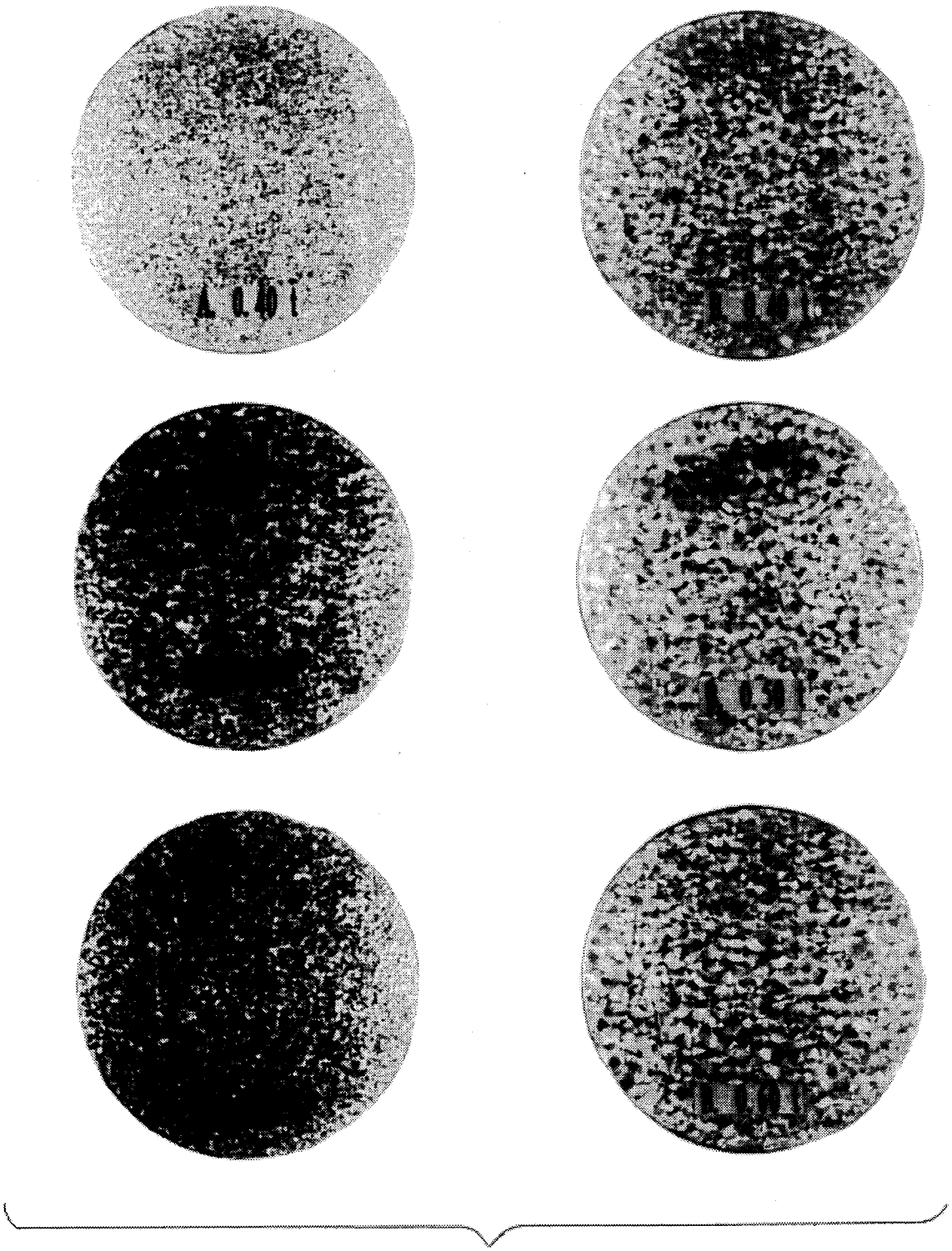
FIG. 2(A) and FIG. 2(B) compare, by thickness of galvalumes, the size of spangle particles formed on the surface of Ti-treated and not-Ti-treated galvalumes.
Figure 2B:
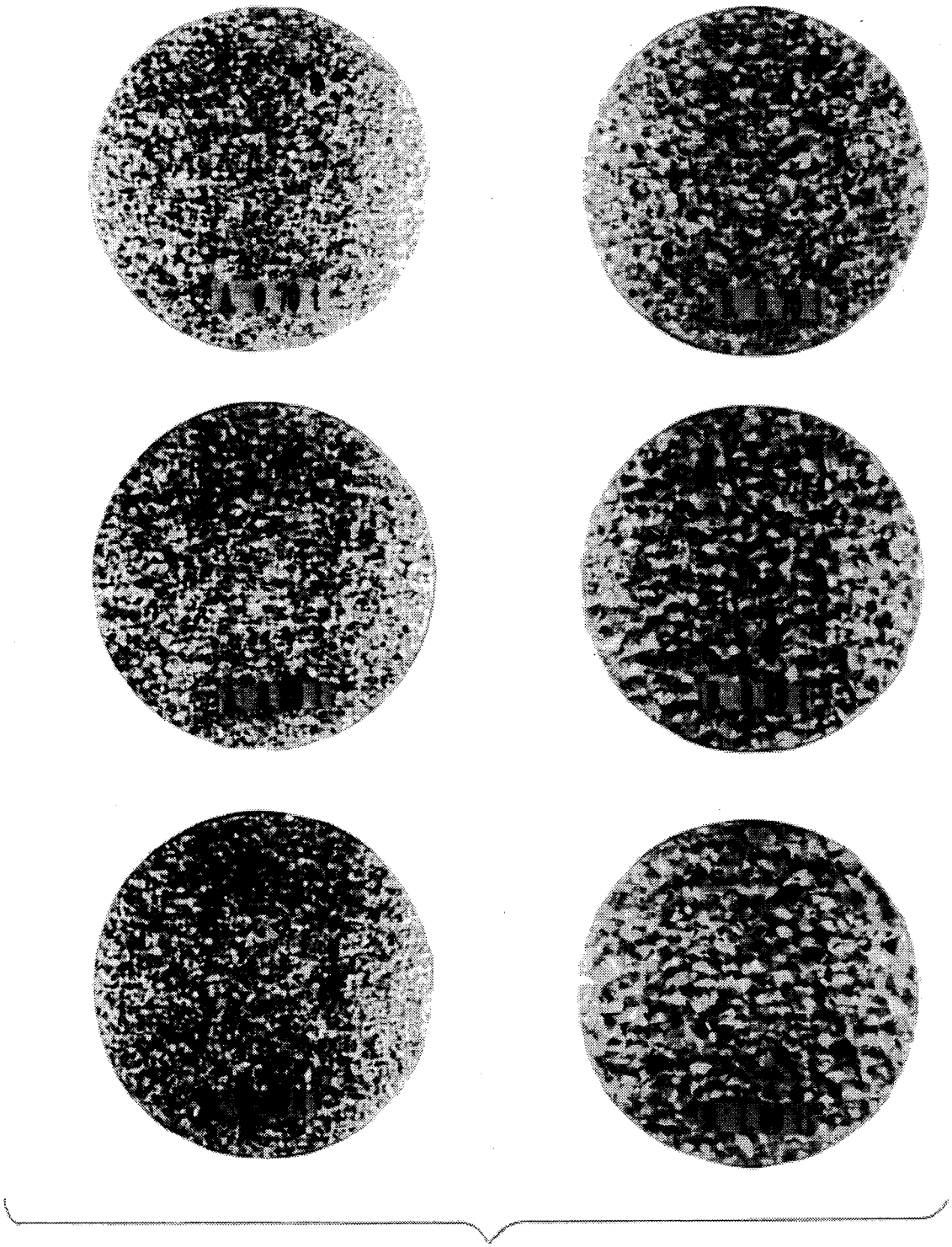
Figure 3:
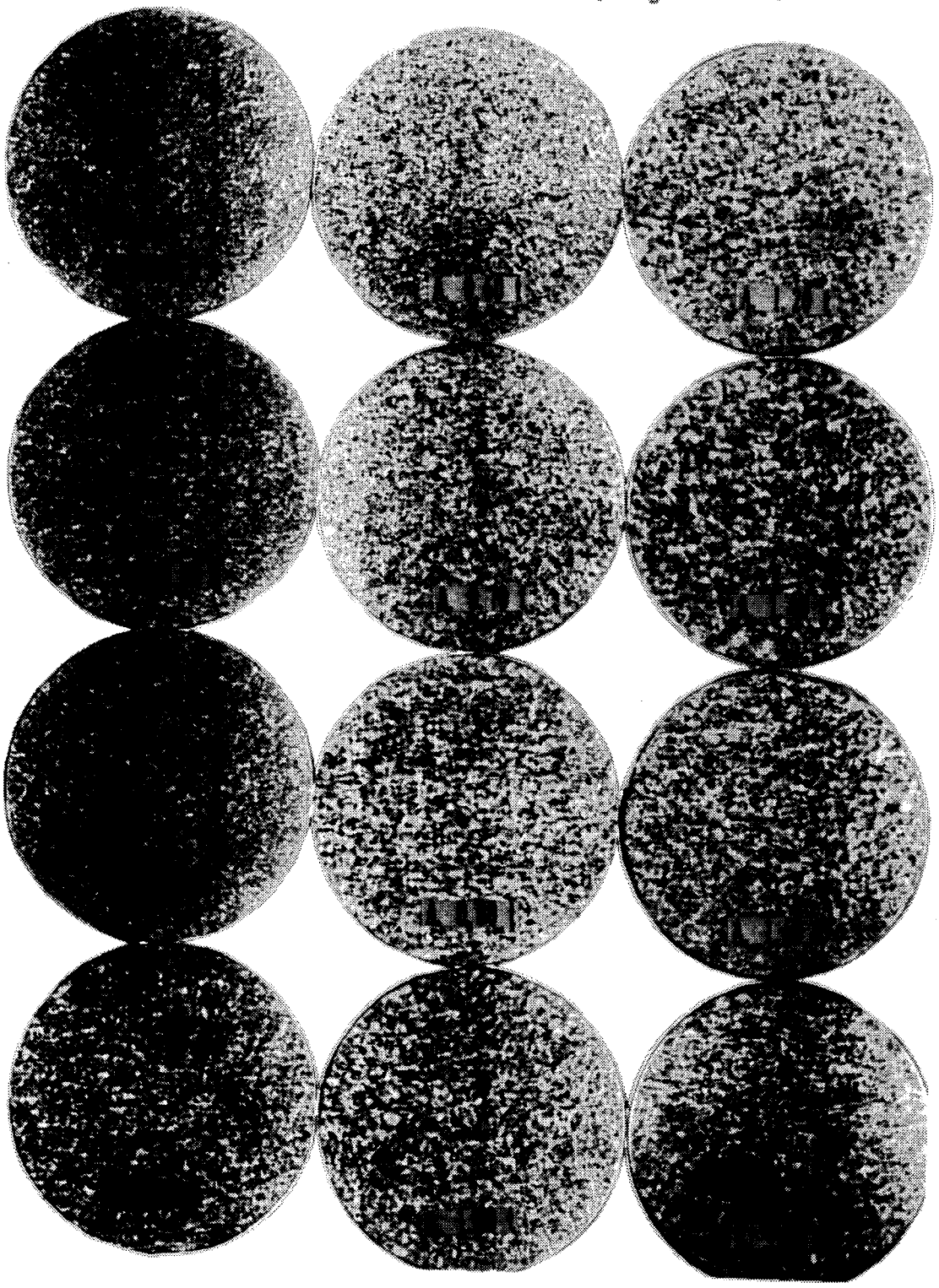
FIG. 3 shows, by thickness of galvalumes, the size of spangle particles formed on the surface of Ti-treated galvalumes.

The size of spangle particles varies greatly depending on the thickness of galvalume due to potential heat thereof. However, as shown in FIG. 2(A) and FIG. 2(B), fine and even spangle particles were formed on the surface of Ti-treated galvalumes irrespective of thickness of the Ti-treated galvalumes.

3. Comparison of corrosive resistance test and film property test.

Salt spray test (S.S.T.) and humidity test (H.T.) were performed to compare corrosive resistance of Ti-treated and not-Ti-treated galvalumes. The results of the test are as follows:

| | Preparation of Sample | | |
|---|---|---|---|
| | Thickness | Amount of Coating | Amount of Cr Coating |
| Ti-treated Galvalume | 0.8 mm | 130 g/m$^2$ | 15.8 mg/m$^2$ |
| Not-Ti-treated Galvalume | 0.8 mm | 130 g/m$^2$ | 16.0 mg/m$^2$ |

| | Test Condition | | | | |
|---|---|---|---|---|---|
| | TEST TIME | | TEST ITEM | CONDITION | KS D 9502 |
| CORROSION RESISTANCE TEST | 900 hr. | S.S.T. | Nacl DENSITY | 5 wt % | 4–6 wt % |
| | | | SPRAY PRESSURE | 1 kg/cm$^2$ | 0.7–1.8 kg/cm$^2$ |
| | | | SPRAY AMOUNT | 2 ml/hr | 0.5–3.0 ml/h |
| | | | TEMPERATURE | 35° C. | 33–37° C. |
| | | | PH | 6.8–6.9 | 6.5–7.12 |
| | | H.T | TEMPERATURE | 49 ± 1° C. | — |
| | | | PH | 95% ↑ | — |
| FILM PROPERTIES TEST | | O-T BENDING TEST | | O-T × 180° | |
| | | IMPACT TEST | | 50 cm × 1.5 kg | |
| | | ERICHSEN TEST | | 5 mm | |

3(a). Comparison of corrosive resistance

Figure 4:
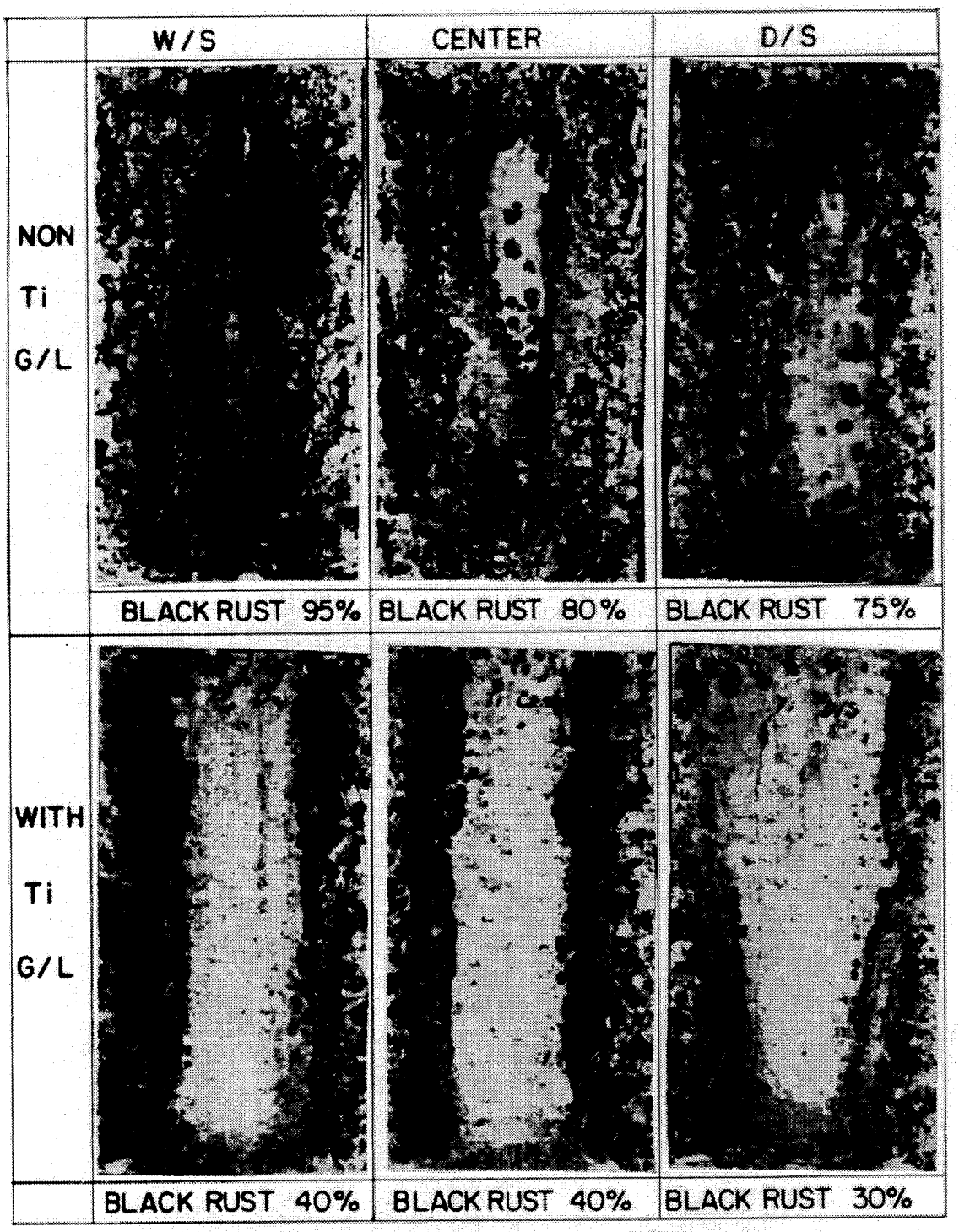
FIG. 4 compares the surface of Ti-treated galvalumes to examine corrosive resistance under salt spraying test.

When examined 900 hours after being sprayed with salt, the corrosive resistance of Ti-treated galvalume was superior to that of not-Ti-treated galvalume (refer to FIG. 4).

Figure 5:
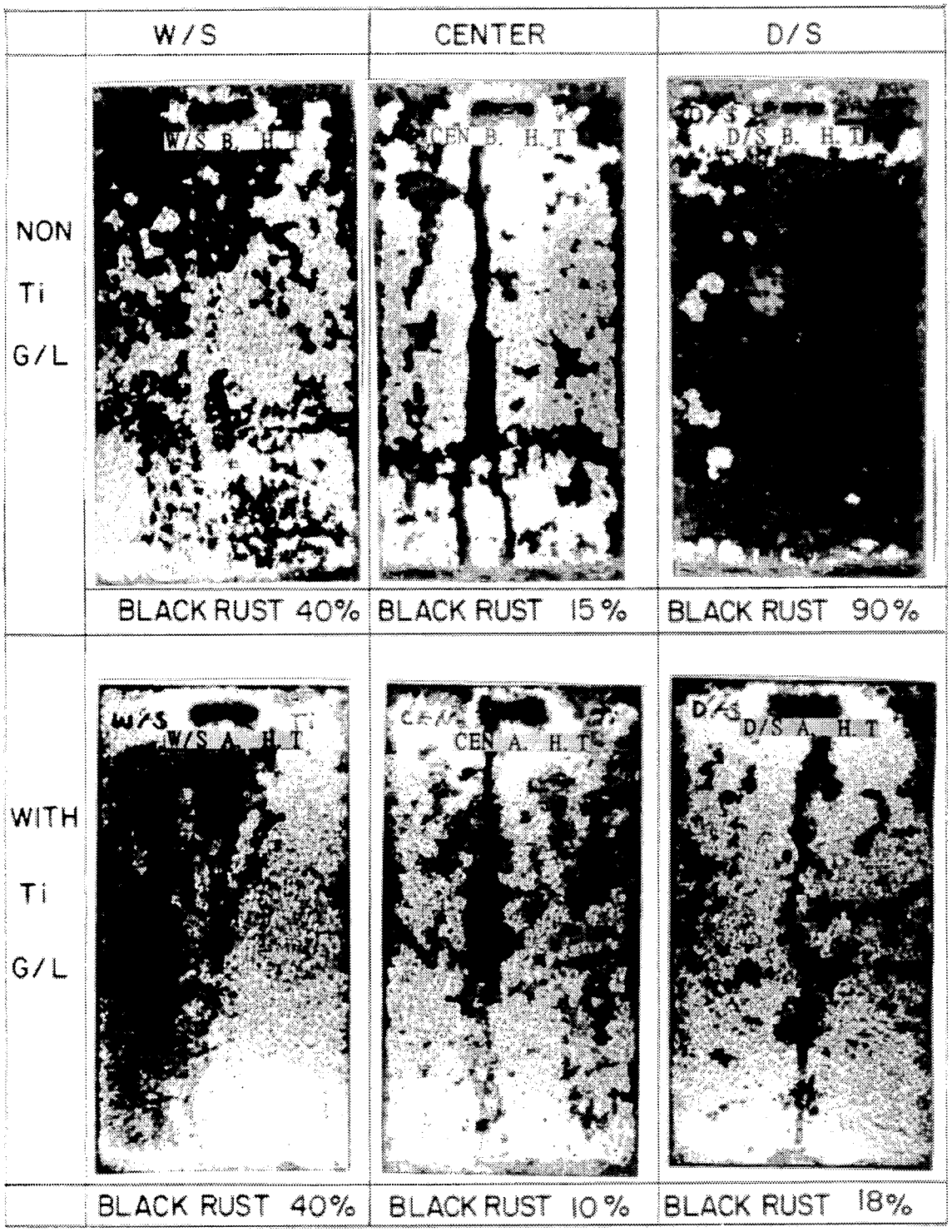
FIG. 5 compares the surfaces of Ti-treated and not-Ti-treated galvalumes to examine corrosive resistance under humidity test.

When examined after 900 hours of exposure to humidity, the corrosive resistance of Ti-treated galvalume was superior to that of not-Ti-treated galvalume (refer to FIG. 5).

3(b). Comparison of coating film property

Figure 6:
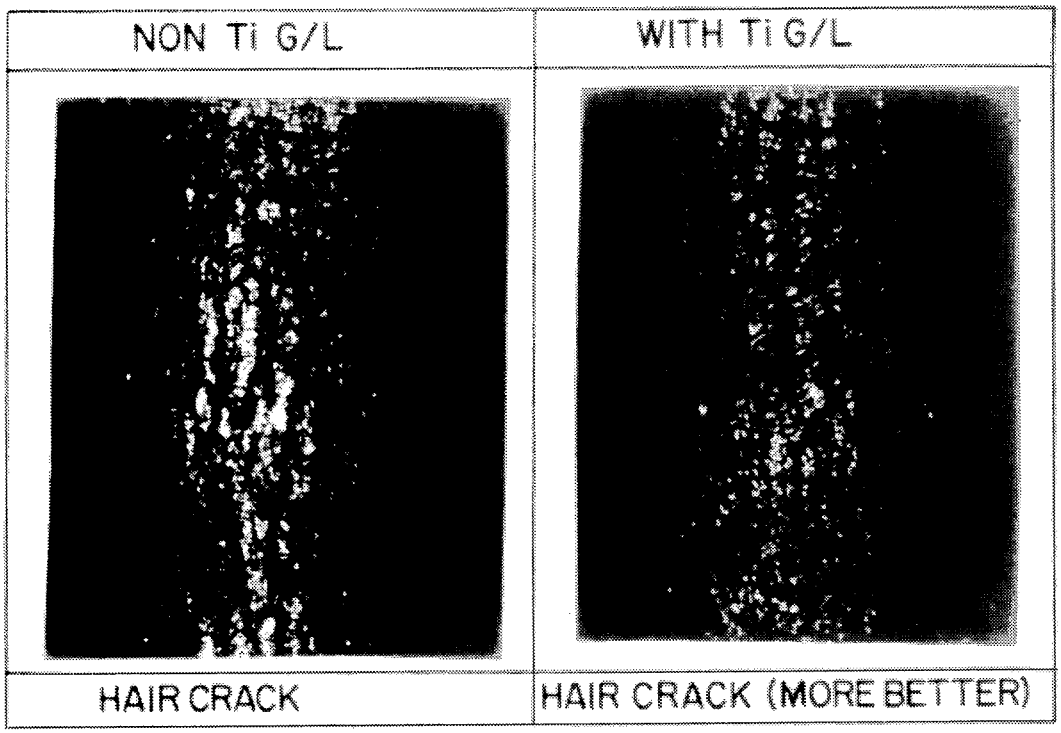
FIG. 6 compares the surface of Ti-treated and not-Ti-treated galvalumes under O-T vending test.

When O-T bending test was performed, "hair crack" appeared on both Ti-treated and not-Ti-treated galvalumes. However, the crack was smaller on the Ti-treated galvalume than on the not-Ti-treated galvalume (refer to FIG. 6).

Figure 7:
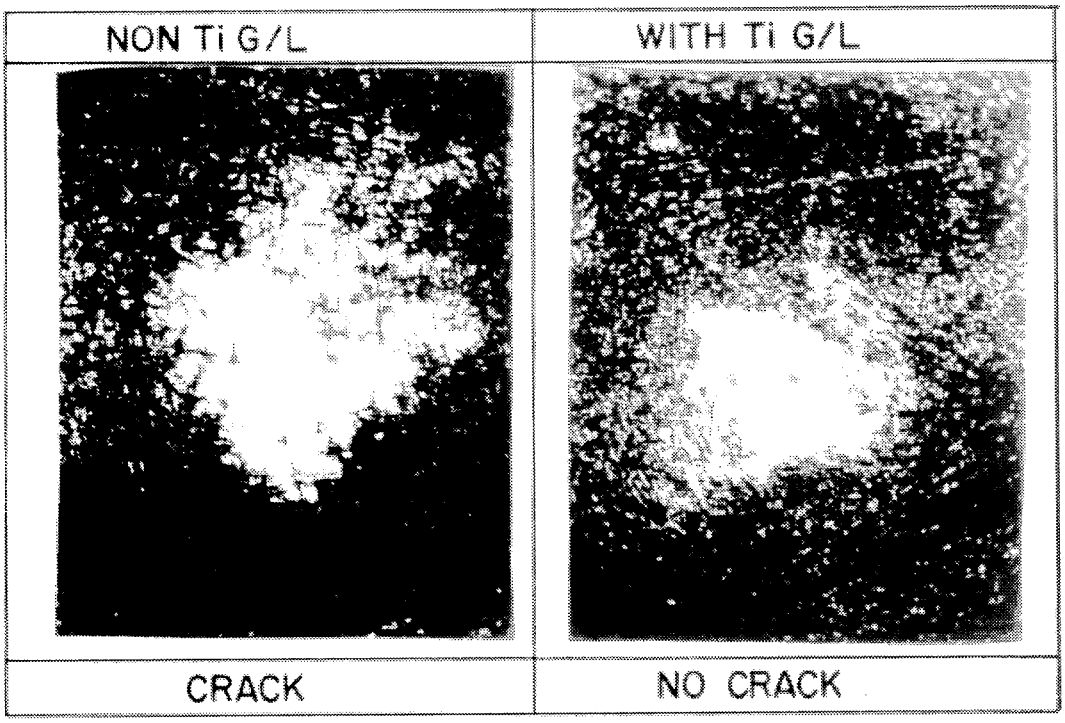
FIG. 7 compares the surface of Ti-treated and not-Ti-treated galvalumes under impact test.

When an impact test was performed, there was a crack on not-Ti-treated galvalume but not on Ti-treated galvalume. (refer to FIG. 7).

Figure 8:
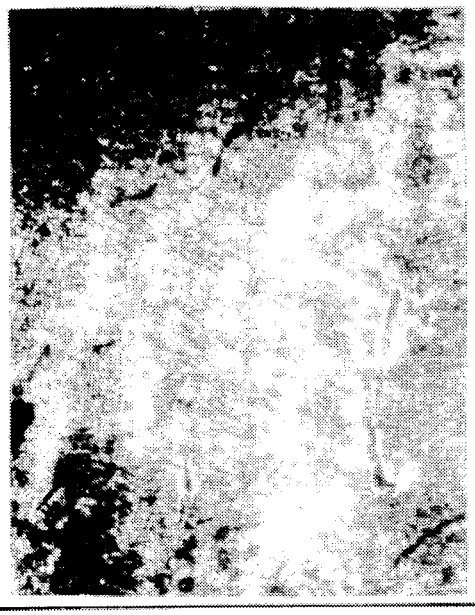
FIG. 8 compares the surface of Ti-treated and not-Ti-treated galvalumes under Erichsen test.
Figure 8:
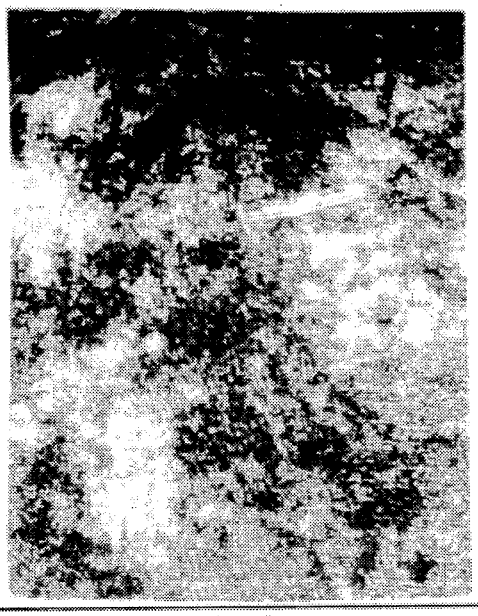

When 5 mm-depth Erichsen test was performed, both types of galvalume did not have cracks, but Ti-treated galvalume appeared to be in better condition than not-Ti-treated galvalume (refer to FIG. 8).

4. General results of testing

4(a). Comparison of spangle size

When Ti at a concentration of 0.001–0.5% by weight of the Composition II was added to the coating pot (1) containing an alloy of Al 55% by weight, Zn 43.4% by weight, and Si 1.6% by weight, the size of spangle particles formed on the surface of galvalumes was evenly minimized irrespective of thickness of the galvalumes because the spangle particles are unaffected by the potential heat of galvalumes.

4(b). Estimations of the corrosive resistance and the property of coating film.

| | | | |
|---|---|---|---|
| (1). S.S.T.: | not-Ti-treated Galvalume | < | Ti-treated Galvalume |
| (2). H.T.: | not-Ti-treated Galvalume | < | Ti-treated Galvalume |
| (3). O-T Bending Test: | not-Ti-treated Galvalume | ≦ | Ti-treated Galvalume |
| (4). Impact Test: | not-Ti-treated Galvalume | < | Ti-treated Galvalume |
| (5). Erichsen Test: | not-Ti-treated Galvalume | ≦ | Ti-treated Galvalume |

As shown in the above tests, according to the present invention, the surface structure, i.e., the spangle particles, of Ti-treated galvalumes remained minute; and thus, its outer appearance, the corrosive resistance, and ease of handling were improved.

What is claimed is:

1. A method of manufacturing a coated steel plate comprising contacting a steel plate with a molten coating composition comprising 55% by weight of Al, 43.3% by weight of Zn, 1.6% by weight of Si and a percentage by weight of Ti.

2. The method according to claim 1, wherein the steel plate is passed through a coating tank containing said coating composition, the coated plate is air wiped and then said air wiped plate is cooled.

3. The method according to claim 2, wherein the Ti contained in said coating composition is derived from a Ti-Al alloy.

4. The method according to claim 3 wherein the Ti-Al alloy is premelted in a premelting pot prior to being introduced into the coating composition.

5. A method of manufacturing a coated steel plate comprising the steps:

(a) providing a first molten coating composition comprising by weight 55% aluminum, 43.4% zinc and 1.6% silicon;

(b) adding molten Ti to said first composition to provide a second composition;

(c) contacting said second composition with a steel plate to be coated.

6. The method according to claim 5 wherein said Ti is added to said first coating composition to provide a concentration of Ti in a range of 0.001–0.5% by weight of said composition.

7. The method according to claim 5, wherein said Ti, in the form of a Ti-Al alloy is pre-melted prior to being added to the coating composition.

8. The method according to claim 5, wherein said Ti contained in said coating composition is derived from a Ti-Al alloy.

9. The method according to claim 8, wherein the Ti-Al alloy is premelted in a premelting pot prior to being introduced into the coating composition.

10. A method of manufacturing a coated steel plate comprising contacting a steel plate with a molten coating composition composed of a first part comprising 55% by weight Al, 43.3% by weight Zn and 1.6% by weight Si, admixed with a second part comprising Ti.

* * * * *